United States Patent [19]

Dodd

[11] 4,330,576

[45] May 18, 1982

[54] RAZOR BLADE COATING AND METHOD

[75] Inventor: Charles G. Dodd, Stratford, Conn.

[73] Assignee: Warner-Lambert Company, Morris Plains, N.J.

[21] Appl. No.: 925,917

[22] Filed: Jul. 19, 1978

Related U.S. Application Data

[63] Continuation-in-part of Ser. No. 770,977, Feb. 22, 1977, abandoned.

[51] Int. Cl.[3] ..... B05D 5/08

[52] U.S. Cl. ..... 427/255.1; 30/346.53; 76/DIG. 8; 427/255.4; 427/284

[58] Field of Search ..... 427/248 A, 248 E, 284, 427/341, 255.1, 255.4; 30/346.53; 76/DIG. 8; 526/43; 264/83; 525/356

[56] References Cited

U.S. PATENT DOCUMENTS 2,811,468 10/1957 Jottre ..... 427/248 E X
3,224,094 12/1965 Esemplare ..... 30/346.53
3,518,110 6/1970 Fischbein ..... 30/346.53 X

FOREIGN PATENT DOCUMENTS 1127633 9/1968 United Kingdom ..... 30/346.53

OTHER PUBLICATIONS

Bergquist, B. et al., *SANDVIK 13C26 Stainless Razor Blade Steel,* Bulletin 66-4E, Steel Research Centre, Sandvik, Sandviken, Sweden, Oct. 1975, p. 1.

*Primary Examiner*—Evan K. Lawrence
*Attorney, Agent, or Firm*—R. S. Strickler

[57] ABSTRACT

A razor blade having a fluorinated polymer coating over its cutting edge and a method for its preparation. A hydrocarbon polymer is disposed on the cutting edge, which polymer after appropriate sintering is brought into contact with a fluorine-rich atmosphere resulting in replacement of a plurality of hydrogen atoms by fluorine atoms creating a multiplicity of ($-CF_2-CF_2-$) groups.

14 Claims, 1 Drawing Figure

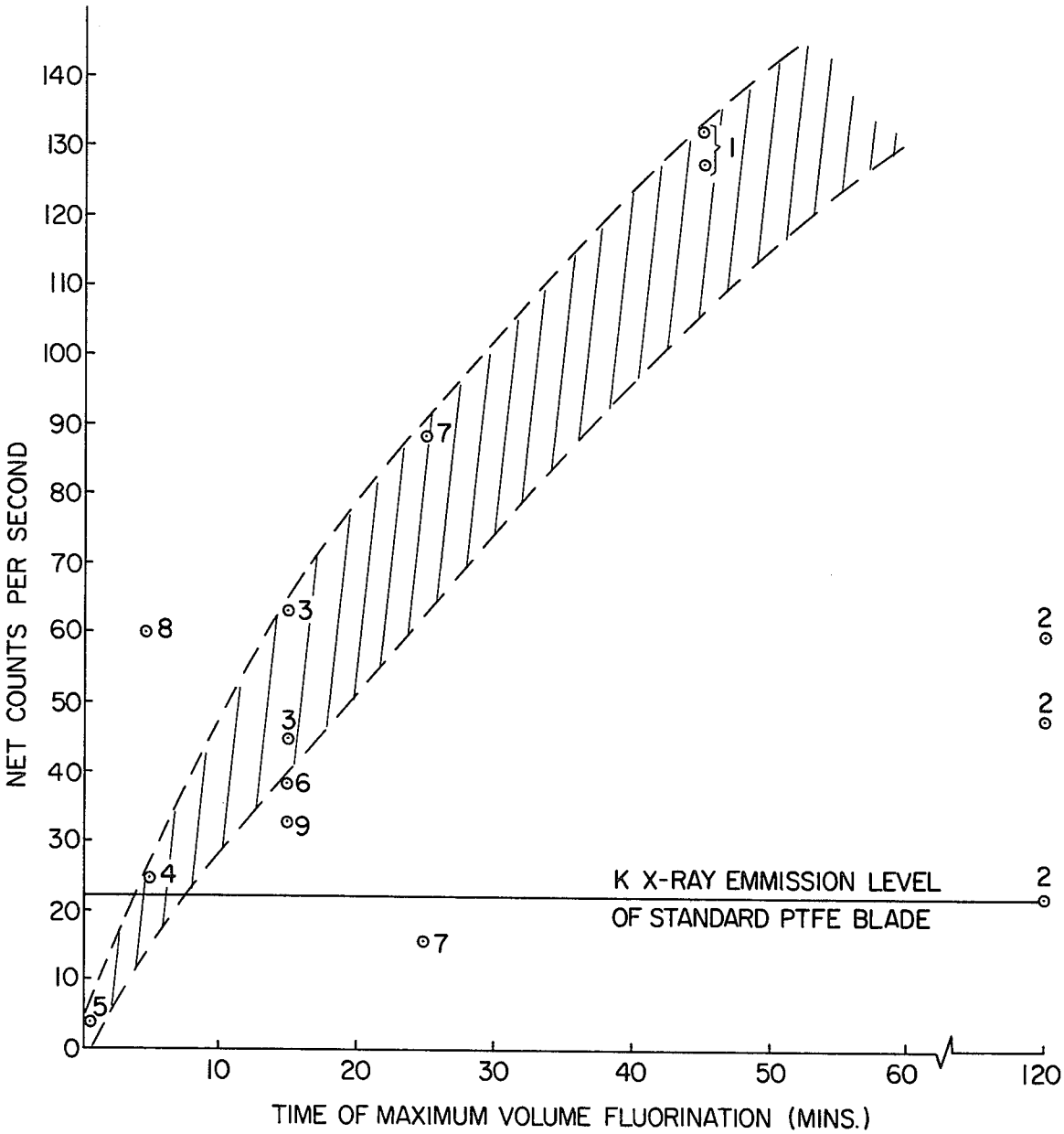
NET COUNTS PER SECOND
140
130
120
110
100
90
80
70
60
50
40
30
20
10
0
10
20
30
40
50
60
120
TIME OF MAXIMUM VOLUME FLUORINATION (MINS.)
K X-RAY EMMISSION LEVEL
OF STANDARD PTFE BLADE

RAZOR BLADE COATING AND METHOD

CROSS-REFERENCE TO RELATED APPLICATION

This application is a continuation-in-part of U.S. application Ser. No. 770,977 filed Feb. 22, 1977, by Charles G. Dodd for RAZOR BLADE COATING AND METHOD.

BACKGROUND OF THE INVENTION

This invention relates to safety razor blades of either the single edge or double edge variety and more particularly pertains to a safety razor blade with a cutting edge on which is an adherent fluorinated polymer coating.

It is known that the shaving properties of razor blades are appreciably enhanced by applying to the cutting edge polymer coatings such as polyfluorocarbons providing low friction characteristics. The prior art, particularly U.S. Pat. No. 3,345,202, Kiss et al, and U.S. Pat. No. 3,203,829, Seyer et al, discloses coating of razor blade edges with polytetrafluoroethylene and other polymeric materials as well as the process for the application of these coatings.

The improvement in shaving produced by the incorporation of low friction polymer coatings on the blade edges is characterized by a decrease in the force required to sever the beard hair manifesting itself in decreased pull and markedly greater comfort and ease. The reduction in pull generally persists during the usable life of the cutting edge and there is reason to believe that the life of the blade is as much determined by the continued existence of the polymer coating as upon deterioration of the edge itself.

Generally razor blades to which the present invention may be applied are usually about 0.0015 to 0.015 inch thick having wedge or arch-shaped cutting edges. The included angle of the edge is normally greater than 14° and less than 35° and the faces or facets of the cutting edges extend back toward the body of the blade for a distance up to as much as 0.1 inch or more. Each facet or face of the edge need not be a single planar continuous surface but may consist of a number of facets formed by successive grinding or honing operations intersecting along zones or lines generally parallel to the ultimate edge. The final facet, i.e., the facet immediately adjacent the edge, may have a width as little as 0.0003 inch or less, which is substantially less than the diameter of a beard hair, which averages between about 0.003 and 0.005 inch. The radius of the ultimate edge is extremely fine, generally as low as 300 Angstroms.

Razor blades are normally made from carbon steel or hardenable stainless steel, but may also be fabricated from other materials, e.g., ceramic, sapphire, etc., as well as amorphous or non-crystalline metal. The method of forming the edge remains substantially the same for each of the materials which may be utilized in a razor blade but does require alteration to suit the specific characteristics of the material. The ultimate edges and facets of razor blades may also be coated with fine layers of other metals and materials, for example, chromium, platinum, aluminum oxide, etc., producing stronger, longer lasting and more corrosion resistant blades. U.S. Pat. No. 3,754,329, Lane, describes and sets forth a blade on which such a coating is placed.

As previously set forth, the use of polytetrafluoroethylene coatings over blade edges contributed an outstanding improvement in blade performance, and is generally accepted as the coating offering the greatest advantages. Other coatings, notably polyethylene, also offer improved shaving performance but normally less than that of the polytetrafluoroethylene. As set forth in the Seyer patent, supra, the coating of blades with polytetrafluoroethylene (PTFE) involves subjecting the blade to temperatures at least in the range of 621° F. (greater than the crystalline melting point of PTFE). This thermal excursion tends, depending upon the time-temperature curve employed, to reduce the hardness of a stainless steel blade edge, thereby contributing to a decrease in edge resistance to mechanical abuse and also to a decrease in blade life. This thermal curing process, which cannot be successfully employed with carbon steel blades, has been the major contributing factor in the virtual elimination of carbon steel blades from the more affluent world markets. It thereby becomes obvious that a reduction in the range of temperatures to which a blade must be exposed would offer substantial benefits in product performance and ultimately to the shaving consumer.

It is therefore an object of the present invention to provide a razor blade product having a low friction polymer coating over its cutting edge without subjecting such edge to temperature excursions of a deleterious nature. Another object of the present invention is to provide a method for producing an adherent fluorinated polymer coating over the cutting edge of a razor blade. Yet another object of the invention is to produce a fluorinated polyethylene polymer coating over the cutting edge of a razor blade.

SUMMARY OF THE INVENTION

In overcoming the disadvantages associated with prior art blade edge coatings and their method of application and in meeting the stated objects, the present invention contemplates the coating of a razor blade edge with a non-fluorine containing polymer and fluorinating such polymer by contact with fluorine atoms to produce a fluorinated polymer.

BRIEF DESCRIPTION OF THE DRAWING

The FIGURE is a graphical representation of data demonstrating the level of fluorination achieved in polyethylene coatings on a number of test blade specimens.

The FIGURE, in combination with the description hereinafter presented, is intended as illustrative of applicant's invention and not delimiting of its scope.

In the present invention, attention is directed to the introduction of fluorine into long chain organic compounds normally identified as polymers. Various methods are available for the substitution of fluorine in place of other halogens as well as hydrogen, oxygen or the amino groups. (See Chapter 4, *Chemistry of Organic Fluorine Compounds,* by Milos Hudlicky published by The McMillan Company, New York, 1962.) In considering this subject, it is worthwhile noting that fluorine and its various compounds are extremely reactive, their handling therefore requiring suitable care and precaution. Undiluted gaseous fluorine reacts even at room temperature with many organic and inorganic materials and even with such substances as asbestos and water. Utmost care is therefore necessary when working with it or employing it in a given process. In the context of the present invention, it is necessary to rigidly adhere to process parameters in order to avoid harmful consequences as well as meet the inventive criteria, particularly the corrosive effects of the fluorine on the stainless steel razor blade body.

Since polytetrafluoroethylene is a plastic in which the hydrogen of polyethylene is replaced by fluorine (see *Hackh's Chemical Dictionary,* 4th Edition, McGraw-Hill Book Company) and polytetrafluoroethylene apparently constitutes the most advantageous coating for razor blade edges, the fluorination of polyethylene coatings was the direction taken in the preferred practice and embodiment of the invention. It must, however, be noted that many other compounds offering enhanced shaving performance when placed on the cutting edge of a razor blade may be fluorinated in substantial accordance with applicant's process.

Fluorination of polyethylene coatings on blade edges has been successfully attained by treatment with elemental fluorine gas at ambient pressure and temperature for times of the order of one minute to two hours with no apparent corrosion of the blade steel. The blade steel employed has the following composition:

| | |
|---|---|
| Cr | 13.0% |
| Mn | 0.65 |
| C | 0.65 |
| Si | 0.45 |
| P | 0.005 |
| S | 0.008 |
| Ni | 0.2 |
| Mo | 0.04 |
| Cu | 0.09 |
| V | 0.2 |
| W | 0.2 |

and is typical of that now used throughout the razor blade industry. Best results are obtained with degreased and ultrasonically cleaned edges on which the polyethylene melts and flows when cured at 130° C. to 190° C., with the preferred curing temperature in the upper end of this range. As is immediately recognized by those of ordinary skill in the art, the maintenance of temperatures in these ranges, approximately the 300° F. range compared to the 600° F. range, results in significant reduction in the impairment of razor steel metallurgy. Optimum fluorination is attainable at low film thicknesses of approximately 500 Angstrom units or less of polyethylene resulting in a highly fluorinated adherent film. Evidence of degree of fluorination is obtained by electron probe analysis, weight gain and infrared spectra, which are test methods generally available in the industry and known to those of ordinary skill in the art.

In the preferred embodiment, the razor blade strip after sharpening and degreasing is further cleaned by ultrasonic method in an aqueous detergent followed by air-drying and an optional final ultrasonic cleaning in Freon 113 (1, 1, 2 - Trichlorotrifluoroethane). The ultrasonic cleaning is found to have beneficial effect in that it permits the polyethylene solutions used for coating to thoroughly wet the steel surface with zero contact angle, thereby producing a somewhat thin polyethylene film of substantially uniform thickness. Any alternate cleaning procedure yielding substantially the same level of cleanliness would be adequate to the practice of this invention.

The polyethylene solutions selected for application are high density polymers with moderately low melt indices, for example, Grade 408A3, melt index 0.80, density 0.962; Grade 3250B melt index 25.0, density 0.955; and Grade 305B2, melt index 0.5, density 0.957, all marketed as Amoco high density polyethylene; and Grade EMN-TR885-MF, melt index 30.0, density 0.965, a commercial grade homopolymer polyethylene containing no antioxidant additives and with all catalyst particles removed, marketed as Marlex by Phillips Petroleum Company. The Amoco resins were made by a Solvay et Cie process using second generation Ziegler catalyst consisting of $TiCl_4$ on a support such as basic magnesium chloride. These resins, while useful, proved less satisfactory for the process because they tend to clump on blade edges and to not cover in a uniform acceptable manner. They also contain traces of residual catalyst and antioxidants which may under favorable circumstances react with the fluorine gas to cause undesirable cross-linking.

The Phillips 885 resin was obtained via their Research and Development Laboratory. This resin is made using a modified chromium oxide catalyst supported on silica. It provided more uniform edge coatings and wetted and flowed acceptably on the cleaned blade edges.

Coatings were applied by dissolving the polyethylene resin to make a 0.5% by weight solution in high boiling decalin (deca-hydro-naphthalene, a mixture of cis-and trans-geometrical isomers), stirring and heating the solution to approximately 120° C. to 130° C., and dipping blade edges or strips in the hot solution. An alternate acceptable solvent is xylene. The coated blades were then drained, dried in air, loaded on a holder, and cured in a tube oven for an hour at 170° C. to 190° C. in flowing nitrogen gas. It is noted that curing times as low as 10 minutes at temperature are sufficient in the practice of this invention. Alternate methods of polymer application to blade edges may be used, for example, (1) spraying a solution on hot blade edges, (2) electrostatic spraying of dry powder, (3) spraying of an aqueous emulsion, and (4) electrodeposition. Electrostatic spraying offers advantages in that additives to the polymer are avoided.

After coating a number of blades with polyethylene films having thicknesses substantially greater than 0.2 microns (2000 Å), for instance, about 3000–5000 Å, fluorination procedures were conducted to exchange the hydrogen bonds of the polyethylene for fluorine bonds, thereby producing a PTFE-like polymer. During fluorination, temperature was maintained at ambient. The blade coatings were subjected to various nitrogen-fluorine mixtures progressively altered to a higher ratio of elemental fluorine to nitrogen, the ratio being selected in order to prevent catastrophic combustion of the hydrocarbon in fluorine and to mimimize the corrosive effect on the blade steel. During the process, the upper thin fluorinated layer of the film sufficiently protects the body of the film so as to permit the use of 100% concentration of elemental fluorine. The gas flow ranged between one and five liters per hour and was reacted with the polyethylene film in a small nickel vessel. The fluorine was conducted from its supply vessel through nickel pipelines approximately ⅛ inch in diameter to a reaction vessel approximately 1 to 1½ inch in diameter and equipment was provided for trapping the effluent gases.

The elemental fluorine gas containing 1% oxygen or less was initially passed over NaF to remove traces of HF. The gas and the apparatus were completely dry so as to avoid undesirable reactions, and all apparatus was completely cleaned and purged prior to commencement of fluorination. A number of different fluorination experiments were carried out in accordance with the following chart:

| Example No. | Resin | | Fluorination Procedure | Time |
|---|---|---|---|---|
| 1 | Batch 305-B2 | 3 blades | $N_2 \rightarrow F_2$ | 15 min. |
| | | | $F_2$ | 45 min. |
| 2 | Batch 305-B2 | 6 blades | $N_2 \rightarrow F_2$ | 15 min. |
| | | | $F_2$ | 120 min. |
| 3 | Batch 305-B2 | 4 blades | $N_2 \rightarrow F_2$ | 15 min. |
| | Batch 885 | 4 blades | $F_2$ | 15 min. |
| 4 | Batch 305-B2 | 5 blades | $N_2 \rightarrow F_2$ | 10 min. |
| | Batch 885 | 4 blades | $F_2$ | |
| 5 | Batch 305-B2 | 5 blades | $N_2 \rightarrow F_2$ | AQAP* |
| | Batch 885 | 5 blades | $F_2$ | 1 min. |
| 6 | Batch 305-B2 | 5 blades | $N_2 \rightarrow N_2/F_2$ | AQAP |
| | Batch 885 | 5 blades | $N_2$/20v % $F_2$ | 15 min. |
| 7 | Batch 305-B2 | 6 blades | $N_2 \rightarrow N_2/F_2$ | AQAP |
| | Batch 885 | 5 blades | $N_2$/20v % $F_2$ | 25 min. |
| 8 | Batch 305-B2 | 3 blades | $N_2 \rightarrow N_2/F_2$ | AQAP |
| | Batch 885 | 3 blades | $N_2$/50v % $F_2$ | 4 min. |
| 9 | Batch 305-B2 | 3 blades | $N_2 \rightarrow N_2/F_2$ | AQAP |
| | Batch 885 | 4 blades | $N_2$/50v % $F_2$ | 16 min. |

*AQAP = As quickly as possible

In Examples 1 through 5, the gas flow was substantially linearly altered from 100% $N_2$ to 100% $F_2$ within the predetermined time period and thereafter exposed to 100% $F_2$ for the second predetermined time period. In Examples 6 through 9, the same procedure was followed except that the $F_2/N_2$ ratio was limited to the indicated volumetric percent.

Upon completion of the foregoing examples, inspection of the blades failed to find any indication of damage to the edge by exposure to the fluorine gas. Weight analysis of the samples indicated a measurable addition of fluorine to the films, i.e., replacement of at least a portion of the hydrogen atoms in the polyethylene by fluorine atoms with a resultant gain in weight. Differential infrared spectra of commercial polyethylene films exposed to the fluorination procedure in each example also showed broadly the spectrum of a PTFE polymer.

In order to more carefully appraise the results of the various procedures, electron microprobe measurements were made on edges of blade specimens from Examples 1 through 9. This work was done using a Cameca MBX Electron Microprobe manufactured in France and sold in the United States by Cameca Instruments, Inc., located at 37 Brownhouse Rd., Stamford, Conn. 06902, in accordance with normal analytical procedure relating detected fluorine K X-ray emission from the polymer films to thickness.

The FIGURE of this application presents graphically the results of such microprobe analysis. The fluorine K X-ray intensity for each sample is plotted against the estimated time of fluorination as set out in the various examples and the level of intensity from a PTFE coated commercial blade is plotted as a horizontal line. Inspection of the data, eliminating the apparently anomalous experimental points of Example 2, shows a broad band of experimental points which may be used to estimate the required time of fluorination for films of varying thickness. It is apparent that in order to fully fluorinate a polyethylene film having thickness approximately equal to that of a commercial PTFE coating, it is required to expose the blade edge to fluorine for about five minutes under conditions set out in Examples 1 through 9. This predicted time is, of course, based upon limited experimental results and therefore subject to variation in accordance with continuing experience with this novel process.

Results also indicate that the fluorine concentration in nitrogen was not critical at the 20%, 50% and 100% by volume levels employed in the fluorination procedures of Examples 1 through 9. Apparently the fluorination reaction kinetics are limited by the diffusion rate of fluorine through the film rather than by the bulk fluorine concentration in the ranges studied. Other inert gases, such as helium or Argon, may find utilization in the practice of this process with minimal alteration of process parameters and results.

These coatings desired for razor blade edges are quite thin, being normally less than about 5,000–10,000 Angstrom units thick, with coating thicknesses less than about 3,000 Angstrom units being preferred. In the examples, relatively thick coatings of polyethylene were used, i.e., greater than the 2500 Angstrom coating normally found on commercial blades, yet these coatings were still in the range of about 3,000–5,000 Angstrom units. Thinner coatings in the range of approximately 500 Angstrom units placed on clean surfaces experience sufficient fluorination in times of a minute or less. Coatings of this thickness result in highly adherent ultra-thin films yielding improved shaving comfort with life at least equal to and perhaps exceeding the performance of coatings now normally employed.

It will be appreciated that dilute atomic fluorine, F, formed from microwave dissociation of elemental fluorine, $F_2$, may instead be used for the fluorination of the polyethylene, with the reaction times adjusted accordingly.

In view of the foregoing description of the preferred embodiment, practice of applicant's invention produced a razor blade having a substantially uniform coating of fluorinated polymer over its cutting edge without subjecting the blade to detrimental excursions in temperature, realizing a shaving product of improved performance over products now extant in the art. In setting forth this description of the preferred embodiment and process of applicant's invention, it is intended that such be illustrative and not restrictive of the scope of the invention set forth in the appended claims. Therefore, all those modifications as would be obvious to one of ordinary skill in the art are considered as coming within the scope and ambit of the invention.

What is claimed is:

1. A method for coating a razor blade edge with a fluorinated polymer, comprising the steps of:

applying a substantially uniform thin coating of a hydrocarbon polymer wherein hydrogen atoms of the polymer may be replaced by fluorine atoms to form a multiplicity of ($—CF_2—CF_2—$) bonds over the cutting edge;

curing the polymer coating to form an adherent thin coating on the cutting edge, said thin coating having a thickness less than about 10,000 Angstrom units; and exposing the cured coating to a flow of gaseous fluorine for a predetermined time and at a predetermined temperature to achieve the replacement of the hydrogen atoms by the fluorine atoms to form the multiplicity of ($—CF_2—CF_2—$) bonds.

2. The method of claim 1 wherein the thickness of said thin coating is less than about 5,000 Angstrom units.

3. The method of claim 2 wherein the hydrocarbon polymer is polyethylene, the curing takes place at a temperature between approximately 130° C. and 190° C. for greater than approximately 10 minutes, and the coating is exposed to a flow of between one and five liters per hour of elemental fluorine.

4. The method of claim 3 wherein the coating is exposed to an increasing volumetric ratio of elemental fluorine to nitrogen for a predetermined period of time.

5. The method of claim 4 wherein the ratio of fluorine to nitrogen increases from 0% to 20% as quickly as possible and continues at the 20% level for a period of 15 minutes.

6. The method of claim 5 wherein the 20% level continues for a period of 25 minutes.

7. The method of claim 4 wherein the ratio of fluorine to nitrogen increases from 0% to 50% as quickly as possible and continues at the 50% level for a period of 4 minutes.

8. The method of claim 6 wherein the 50% level continues for a period of 16 minutes.

9. The method of claim 4 wherein the ratio linearly increases from 0% to 100% in a period of 15 minutes and the blade is thereafter exposed to pure elemental fluorine for a second period of 45 minutes.

10. The method of claim 4 wherein the ratio linearly increases from 0% to 100% in a period of 15 minutes and the blade is thereafter exposed to pure elemental fluorine for a second period of 120 minutes.

11. The method of claim 4 wherein the ratio linearly increases from 0% to 100% in a period of 15 minutes and the blade is thereafter exposed to pure elemental fluorine for a second period of 15 minutes.

12. The method of claim 4 wherein the ratio linearly increases from 0% to 100% in a period of 15 minutes and the blade is thereafter exposed to pure elemental fluorine for a second period of 5 minutes.

13. The method of claim 4 wherein the coating is cured for a period of one hour at a temperature between approximately 170° C. and 190° C. in flowing nitrogen gas, and wherein the coating is a polyethylene resin dissolved in high boiling decalin to make a 0.5% by weight solution at a temperature between approximately 120° C. and 130° C.; and the edges coated by dipping in the hot solution.

14. The method of claim 4 wherein the edges are coated by spraying a solution of polyethylene thereon.

* * * * *